US010928056B2

(12) United States Patent
Bai et al.

(10) Patent No.: US 10,928,056 B2
(45) Date of Patent: Feb. 23, 2021

(54) LIGHTING DEVICE

(71) Applicant: OPPLE LIGHTING CO., LTD., Shanghai (CN)

(72) Inventors: Kun Bai, Shanghai (CN); Hongbo Wang, Shanghai (CN); Yisheng Xiao, Shanghai (CN); Liang Cao, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 171 days.

(21) Appl. No.: 16/222,579

(22) Filed: Dec. 17, 2018

(65) Prior Publication Data

US 2019/0128512 A1 May 2, 2019

Related U.S. Application Data

(63) Continuation of application No. PCT/CN2017/085365, filed on May 22, 2017.

(51) Int. Cl.
*F21V 29/83* (2015.01)
*F21S 8/08* (2006.01)
(Continued)

(52) U.S. Cl.
CPC ..... *F21V 29/83* (2015.01); *F21K 9/232* (2016.08); *F21S 8/08* (2013.01); *F21V 23/004* (2013.01);
(Continued)

(58) Field of Classification Search
CPC ..... F21V 29/83; F21V 29/503; F21V 29/506; F21V 23/004; F21V 23/006; F21K 9/232;
(Continued)

(56) References Cited

U.S. PATENT DOCUMENTS

2010/0265710 A1* 10/2010 Xiao ..... F21V 29/777 362/249.02
2012/0206910 A1 8/2012 Watson
(Continued)

FOREIGN PATENT DOCUMENTS

CN 202432345 U 9/2012
CN 102809069 A 12/2012
(Continued)

OTHER PUBLICATIONS

Liu Zhiwen, "CN2013671346U Large-power LED lamp bulb", Jun. 25, 2014, EPO Machine translation of CN2013671346U, pp. 1-9.*
(Continued)

*Primary Examiner* — Alan B Cariaso
(74) *Attorney, Agent, or Firm* — Arch & Lake LLP

(57) ABSTRACT

The present disclosure discloses a lighting device, including: a housing, an optical element connected with the housing, a receiving chamber formed by engaging the housing with the optical element, and a light source component and a driving power supply component both located in the receiving chamber. The lighting device further includes a passage located in the receiving chamber, the passage passes through the housing and the optical element, and an interior of the lighting device is communicated with an exterior of the lighting device by the passage.

20 Claims, 7 Drawing Sheets

(51) Int. Cl.

| | |
|---|---|
| ***F21K 9/232*** | (2016.01) |
| ***F21V 29/503*** | (2015.01) |
| ***F21V 23/00*** | (2015.01) |
| ***F21V 29/506*** | (2015.01) |
| *F21Y 107/40* | (2016.01) |
| *F21Y 115/10* | (2016.01) |

(52) U.S. Cl.
CPC ..... *F21V 29/503* (2015.01); *F21V 29/506* (2015.01); *F21Y 2107/40* (2016.08); *F21Y 2115/10* (2016.08)

(58) Field of Classification Search
CPC ..... F21K 9/235; F21K 9/237; F21K 9/238; F21S 8/08; F21Y 2107/30; F21Y 2107/40
See application file for complete search history.

(56) References Cited

U.S. PATENT DOCUMENTS

2015/0092404 A1* 4/2015 Kim ..... F21K 9/232 362/227
2016/0123571 A1* 5/2016 Chan ..... F21V 29/83 362/249.01
2016/0223180 A1* 8/2016 Jiang ..... F21V 23/009
2016/0320047 A1* 11/2016 Zhou ..... F21S 2/00

FOREIGN PATENT DOCUMENTS

| | | | |
|---|---|---|---|
| CN | 203671346 | U | 6/2014 |
| CN | 204313038 | U | 5/2015 |
| CN | 105937715 | A | 9/2016 |
| CN | 205678461 | U | 11/2016 |

OTHER PUBLICATIONS

Quing Dubei, "CN102809069A Full-illuminating angle LED (Light Emitting Diode) bulb lamp", Dec. 5, 2012, EPO Machine translation of CN102809069A, pp. 1-5.*
Zhou Junliang, "CN204313038U High-power LED lamp", May 6, 2015, EPO Machine translation of CN204313038U, pp. 1-9.*
International Search Report (including English translation) and Written Opinion issued in PCT/CN2017/085365, dated Aug. 18, 2018, 11 pages.

* cited by examiner

LIGHTING DEVICE

CROSS-REFERENCE TO RELATED APPLICATIONS

This application is based upon and claims the priority of PCT patent application No. PCT/CN2017/085365 filed on May 22, 2017 which claims the priority of Chinese Patent Application No. 201610469654.8 filed on Jun. 23, 2016 and Chinese Patent Application No. 201620637532.0 filed on Jun. 23, 2016, the entire content of all of which is hereby incorporated by reference herein for all purposes.

TECHNICAL FIELD

The examples of the present disclosure relate to the field of lighting technology, and particularly to a lighting device.

BACKGROUND

An lighting device generally illuminates an object by emitting light from an electrically driven, light source component, and then adjusts a lighting effect of the lighting device by regulating an electric current supplied to the light source component through a driving power supply component. However, during use of the lighting device, both the light source component and the driving power supply component through which the electric current passes will generate heat and the heat may cause a decline of reliability of the lighting device.

SUMMARY

The present disclosure provides a lighting device and a method of manufacturing a lighting device.

Examples of the present disclosure provide a lighting device. The device may include: a housing, an optical element connected with the housing, a receiving chamber formed by engaging the housing with the optical element, a light source component and a driving power supply component both located in the receiving chamber, and a passage located in the receiving chamber, where the passage may pass through the housing and the optical element, and an interior of the lighting device is communicated with an exterior of the lighting device by the passage.

Examples of the present disclosure also provide a method of manufacturing a lighting device. The method may include providing a housing, and an optical element connected with the housing, forming a receiving chamber by engaging the housing with the optical element, providing a light source component and a driving power supply component both located in the receiving chamber, and providing a passage located in the receiving chamber, where the passage passes through the housing and the optical element, and an interior of the lighting device is communicated with an exterior of the lighting device by the passage.

It is to be understood that both the foregoing general description and the following detailed description are exemplary and explanatory only and are not restrictive of the present disclosure.

BRIEF DESCRIPTION OF THE DRAWINGS

The drawings described herein are used to provide a further understanding of the present disclosure and constitute a part of the present disclosure. The examples of the present disclosure and the descriptions thereof are used to explain the present disclosure but not to constitute improper limitations to the present disclosure. In the drawings.

DETAILED DESCRIPTION

Figure 1:
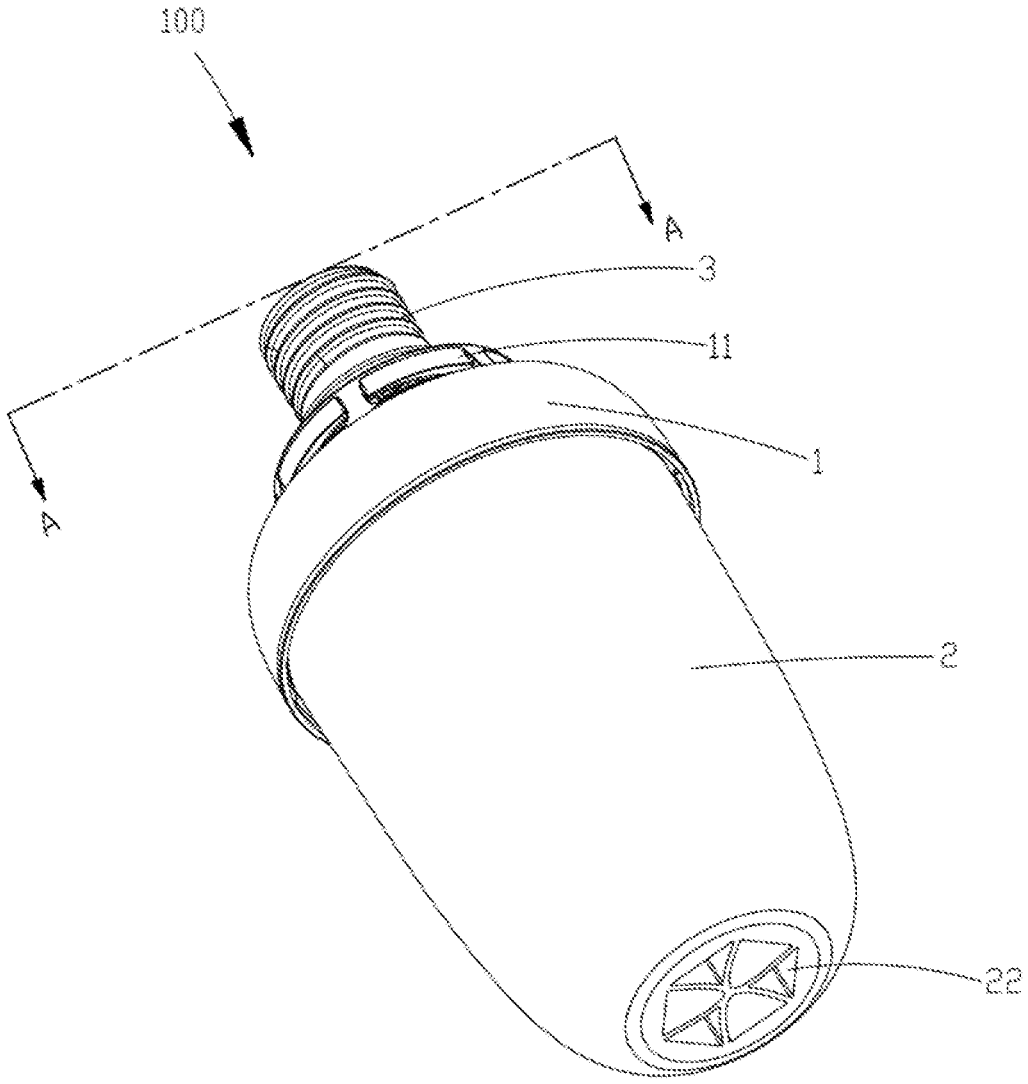
FIG. 1 is a perspective assembling view of a lighting device according to an example of the present disclosure.
Figure 2:
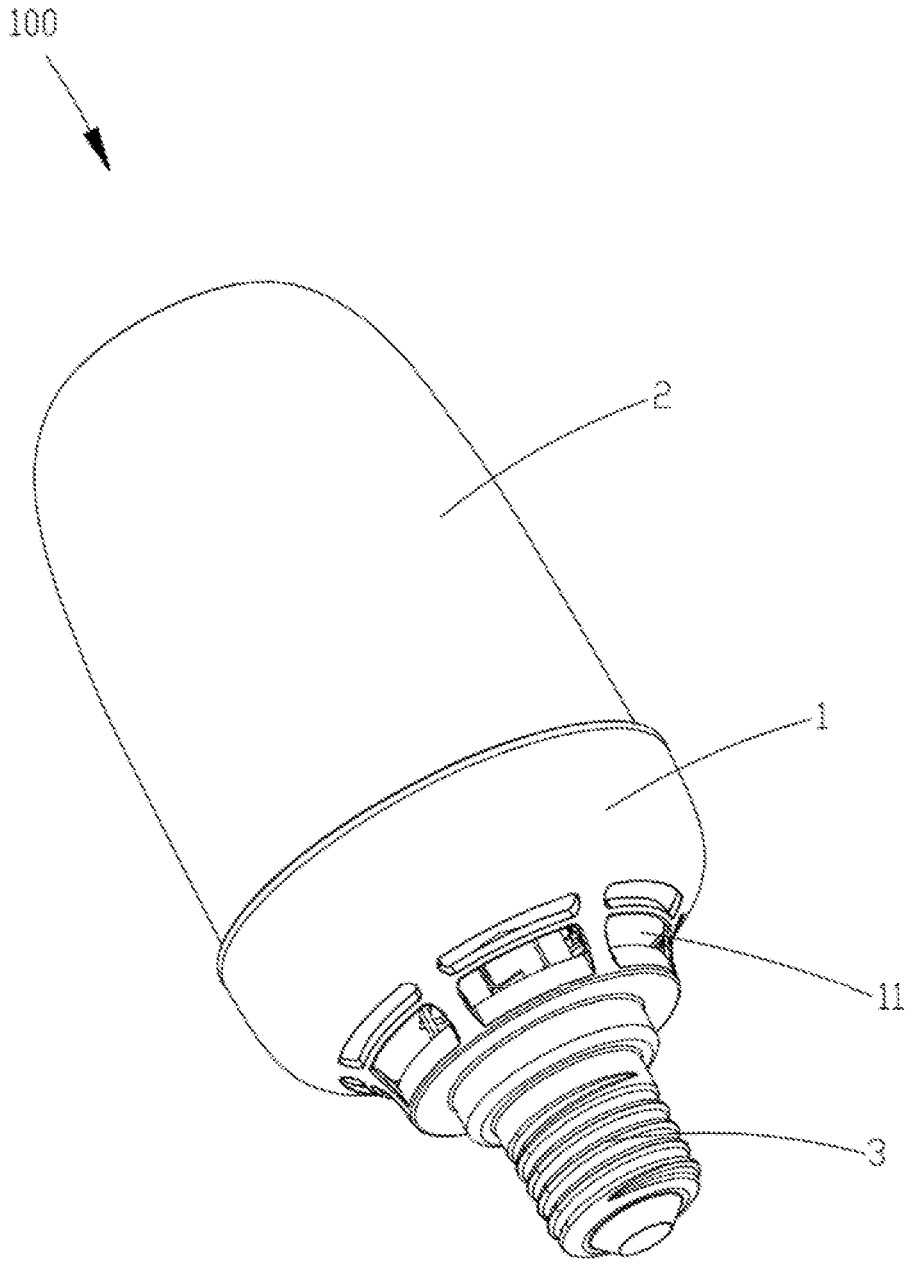
FIG. 2 is an exploded view of FIG. 1 from another viewing angle.
Figure 3:
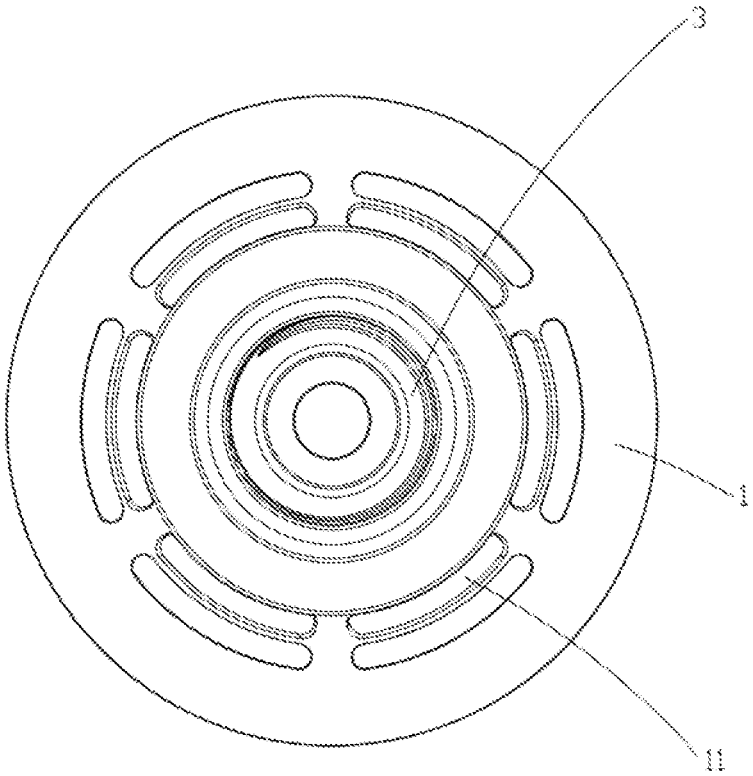
FIG. 3 is a plan view of FIG. 1.

In order to make objects, technical details and advantages of the examples of the disclosure more apparent, the technical solutions of the examples will be described in a clearly and fully understandable way in connection with the drawings related to the examples of the disclosure. Apparently, the described examples are just a part but not all of the examples of the present disclosure. Based on the described examples herein, those skilled in the art can obtain other example(s), without any inventive work, which should be within the scope of the disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The lighting device, especially high-power lighting device, generally has a heat dissipation structure which is additionally disposed between a lamp housing and a cover. The heat dissipation structure is mostly made of aluminum alloy, has many fins closely arranged thereon, and is complicated and heavy. The heat dissipation structure is added to reduce a temperature of the entire lighting device when it emits light, which increases a weight and also a cost of the entire lighting device.

FIGS. 1 to 7 illustrate different views of a lighting device 100 provided by an example of the present disclosure. In FIGS. 1-7, the lighting device 100 is a high power bulb lamp. The lighting device 100 includes a housing 1, an optical element 2 and a lamp head 3. The optical element 2 is connected with an end of the housing 1 in a mounting direction (in a height direction or an up and down direction of the lighting device 100 in the example of the present disclosure), and the lamp head 3 is connected with the other end of the housing 1. The housing 1 is connected with the optical element 2 to form a receiving chamber 7. A light source component 4, a driving power supply component 5 electrically connected with the light source component 4, and a flow guide plate 6 are received in the receiving chamber 7. An interior of the lighting device 100 is provided with a plurality of passages 8, through which the interior of the lighting device 100 is communicated with an exterior of the lighting device 100. Each of the plurality of passages 8 passes through the optical element 2, the light source component 4, the flow guide plate 6, and the housing 1. The passage 8 described above can achieve cross-ventilation between external air and internal air of the lighting device 100. The lighting device 100 described above can be a high-power LED lamp for indoor lighting or industrial lighting, and can be installed on a mounting base such as a ceiling or the like. The lamp head 3 is electrically connected with the driving power supply component 5 located in the lighting device, and allows the lighting device 100 to be electrically connected with the municipal electric power.

Respective components and connection relationships among these components in the lighting device 100 provided by the examples of the present disclosure are described below.

Referring to FIG. 1 to FIG. 7, the housing 1 is in a cover shape and is integrally formed of an insulation material. The housing 1 includes a semicircular main body portion 110 and a connection portion 120 located at the top of the main body portion. The connection portion 120 is configured to be engaged with the lamp head 3. In an example of the disclosure, the lamp head 3 and the connection portion 120 are threaded by internal threads on the lamp head and external threads on the connection portion. In other examples, the lamp head 3 may also be integrally formed with the housing 1, e.g., by way of overmolding.

A plurality of first ports 11 is formed on an outer circumference wall of the housing 1, and a space inside the housing 1 can be communicated with a space outside the lighting device 100 by the first ports 11. The first port 11 is in an arc shape, and the plurality of first ports 11 are arranged in a ring shape on an outer circumference wall of the main body portion 110 to form two concentric rings to reinforce the communication between the space inside the housing 1 and the space outside the lighting device 100. In other examples, the first ports 11 may be arranged in a form of a single ring or multiple rings, and the first ports 11 may have other shapes and may be arranged in other forms. A plurality of positioning posts 12, a plurality of first slots 13, a plurality of first ribs 14 and a plurality of second ribs 15 are formed on an inner surface of a side wall of the main body portion 110 of the housing 1.

The plurality of positioning posts 12 and the plurality of first slots 13 are configured to position the light source component 4 and the flow guide plate 6, respectively. The plurality of first ribs 14 and the plurality of second ribs 15 are configured to be connected with the optical element 2 and to position the flow guide plate 6, respectively. The plurality of positioning posts 12 are disposed at intervals, each located between adjacent first ports 11 and extending in a strip shape along the mounting direction. The positioning post 12 is provided with a first positioning hole 121. The first slot 13 is located higher than the positioning post 12 and is adjacent to the connection portion 120. The first ribs 14 are disposed at an inner side of a lower end edge of the main body portion 110 and are spaced apart from each other along a circumference of the lower end edge. The plurality of second ribs 15 are disposed at intervals, each extending in a strip structure along the mounting direction.

The optical element 2 adopts a hollow, prolate ellipse-shaped bulb shell which is integrally formed of an insulating material such as plastic. A holding portion 21 with a ring shape is protruded from an end of the optical element 2 which is configured to be connect with the housing 1. The holding portion 21 is connected to the first rib 14 in a snap-clip manner. In other examples, structures on the optical element 2 and the housing 1 for the snap-clip connection can be exchanged. The other end of the optical element 2 is a generally planar end portion 220 having a predetermined thickness, the end portion 220 is connected with the other end of an elliptical sidewall having a gradually decreased outer diameter of the optical element 2. Several first openings 22 are formed at intervals in an inner surface of the end portion 220, thus a flow guide portion 23 is provided.

In an example of the present disclosure, the flow guide portion 23 is constituted by a plurality of ribs 231, and each of the plurality of ribs 231 is located between adjacent first openings 22. The space inside the housing 1 can be communicated with the space outside the lighting device 100 by the first openings 22. The first opening 22 has a triangular column shape, and the plurality of first openings 22 are arranged in a circumferential array on the end portion 220 to form a polygonal shape. An outer diameter formed by the first openings 22 has a maximum dimension smaller than that of an outer diameter formed by the first ports 11. In other examples, the first opening 22 can be in other shapes and arranged in other forms. The optical element 2 may also adopt a TIR lens, a COB lens, or a bulb-type light uniform cover, or a combination of a lens and a bulb shell. For a ring-shaped light source, the optical element may also be correspondingly arranged in a ring shape.

Figure 4:
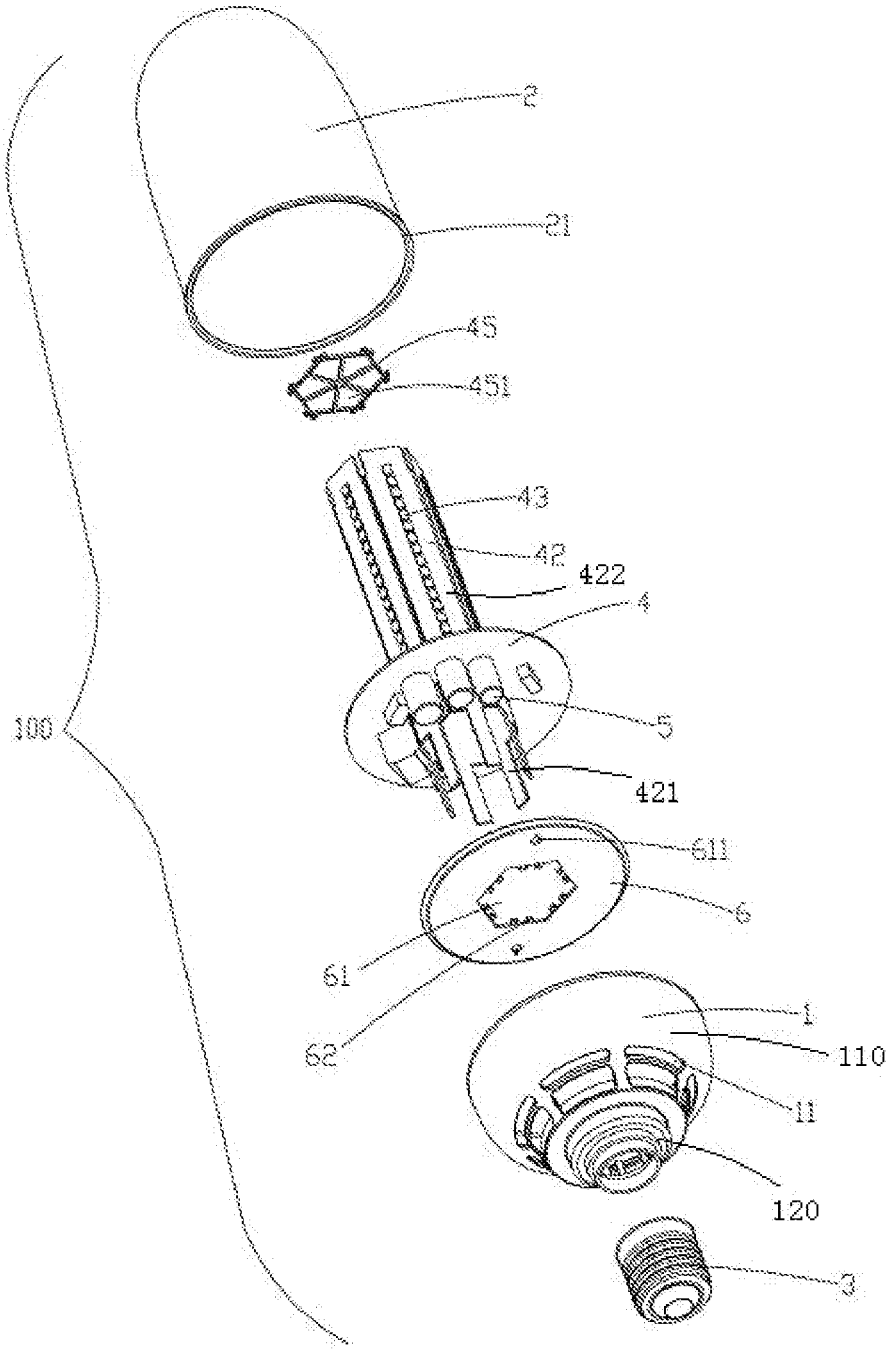
FIG. 4 is an exploded view of FIG. 1.
Figure 5:
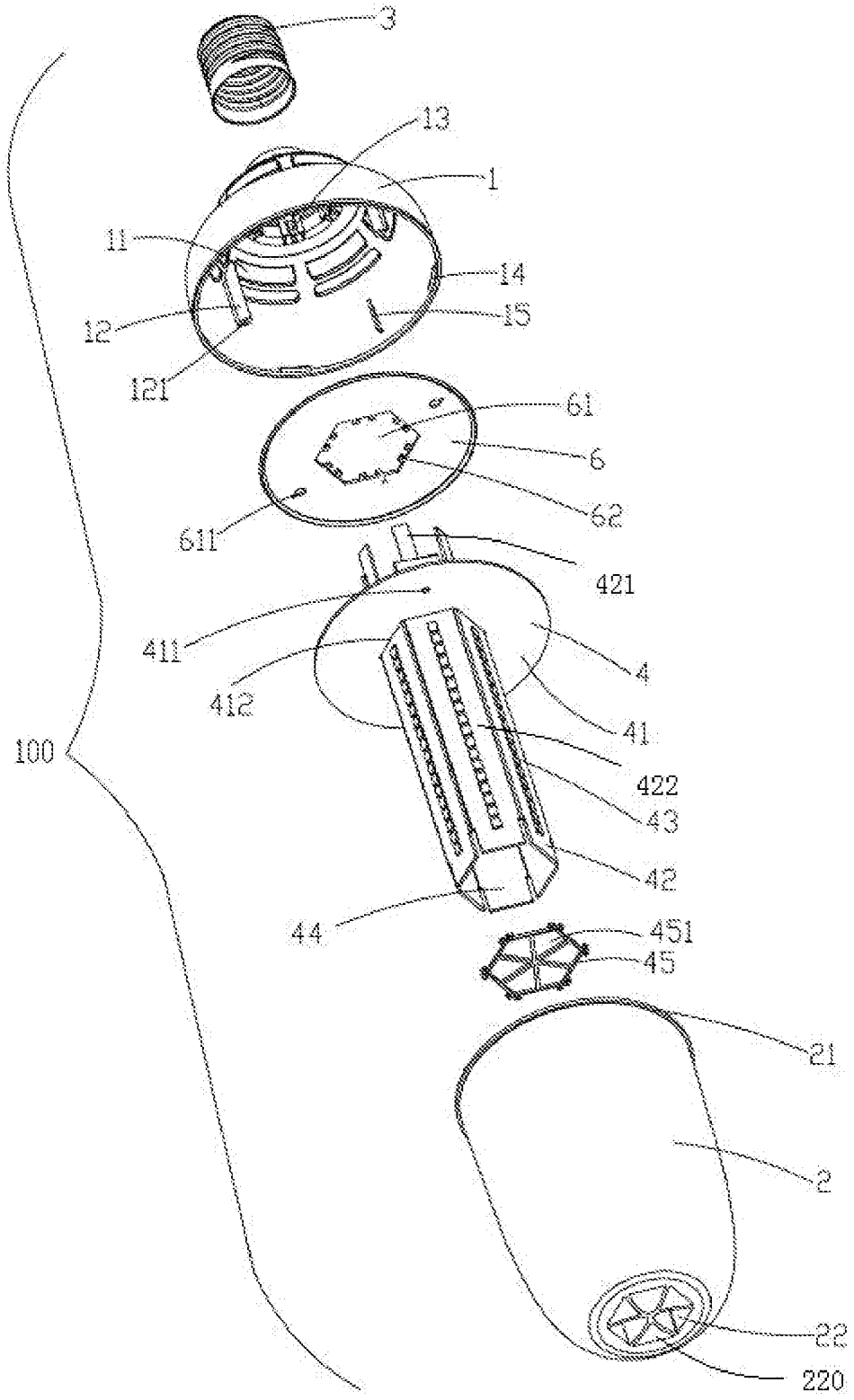
FIG. 5 is an exploded view of FIG. 2.
Figure 6:
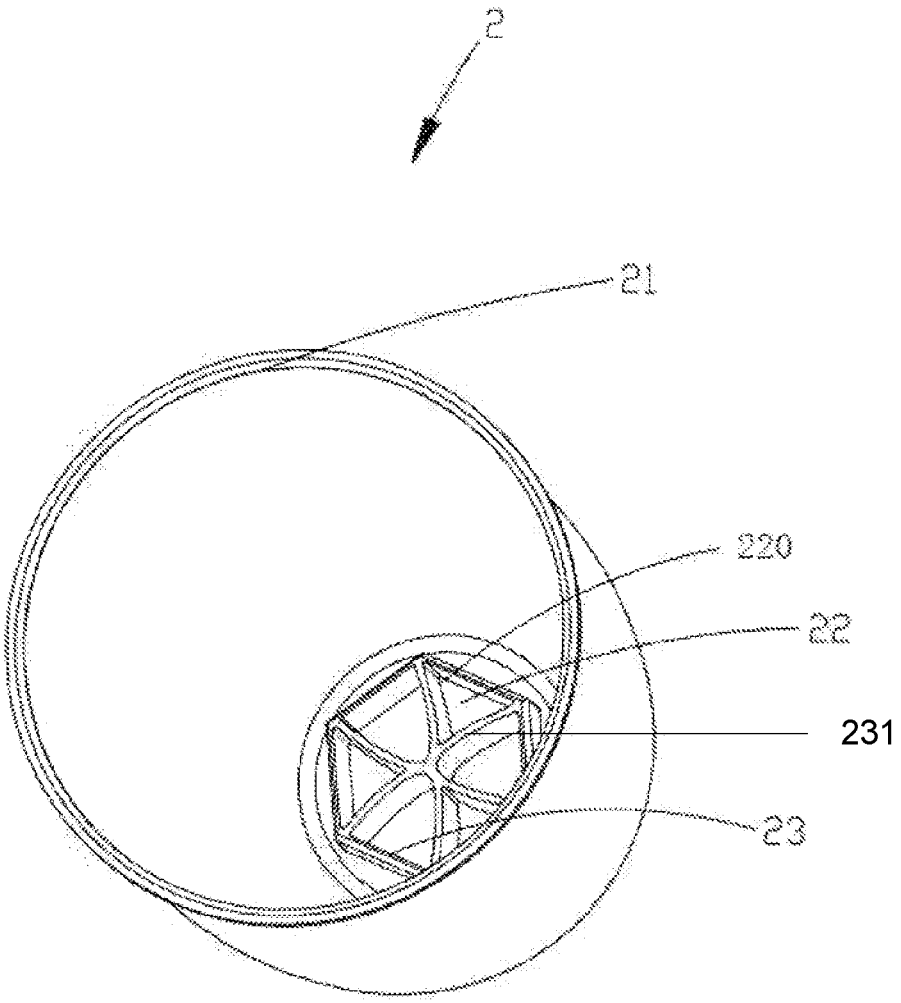
FIG. 6 is a schematic diagram of an optical element in a lighting device according to an example of the present disclosure.

As illustrated in FIG. 4 and FIG. 5, the light source component 4 includes: a circular first base plate 41 which is formed by extending along a horizontal plane perpendicular to the mounting direction; a plurality of second base plates 42 which is snap-fitted at the first base plate 41 and extends in the mounting direction; light sources 43 disposed on each of the plurality of second base plates 42; and a fixing ring 45 configured to fix the plurality of second base plates 42. The second base plates 42 are mainly fixed by the first base plate 41 in an up-and-down direction and by the fixing ring 45. The first base plate 41 is in a circular shape. An optical chamber (not labeled) configured to receive the light sources 43 is delimited by the first base plate 41 and the optical element 2. The first base plate 41 is provided with two second positioning holes 411 and a first through hole 412. The two second positioning holes 411 are for positioning, and the first through hole 412 is for receiving the second base plates 42 snap-fitted therein and is disposed in the middle of the first base plate 41. The first through hole 412 is in a polygonal shape. A light source 43 may also be provided at a vacant position of the first base plate 41 in the direction in which a horizontal plane of the first base plate 41 extends.

In an example of the present disclosure, six second base plates 42 are provided, and each second base plate 42 is snap-fitted into a slot (not illustrated) in the first through hole 412; the second base plate 42 has a first portion 421 extending beyond the first through hole 412 and has a second portion 422 for bearing the light source 43. A sidewall of the extended end of the second portion 422 is in close contact with a sidewall of the first opening 22 of the optical element 2, that is, the second portion is snap-fitted in the first opening 22. The second base plates 42 are disposed perpendicular to the first base plate 41 to form a hexagonal pipeline 44 used as a hollow heat dissipation passage, and the light sources are located on an outer side of the pipeline 44. In this example, the light source 43 adopts an LED light source, and each of the second base plates 42 is provided with a set of vertically arranged LED light source 43, each LED light source 43 can emit any one of white light (W), red light (R), blue light (B) and green light (G). In other examples, the light source may adopt other light sources such as TL.

The fixing ring 45 is snap-fitted at an end of the second base plate 42 extending towards the optical element 2 and is placed on an inner surface of an end of the optical element 2, for fixing the second base plates 42. In the present example, the fixing ring 45 is made of a plastic material and is in a shape of hexagonal, six grids 451 are formed in the hexagon, and the first opening 22 is communicated with the pipeline 44 by the grid 451. In other examples, the fixing ring 45 may also be in any other shapes.

The driving power supply component 5 includes a plurality of components, including but not limited to an LED driving controller chip, a rectifier chip, a resistor, a capacitor, a fuse, coils, etc. The driving power supply component 5 and the light source component 4 are electrically connected with each other and are integrally provided, and are installed on both sides of the first base plate 41, respectively. In other examples, the driving power supply component 5 and the light source component 4 may also be disposed on the same side of the first base plate 41, or the driving power supply component 5 may also be disposed around the outer side of the second base plate 42, or the driving power supply component 5 and the light source component 4 may also be arranged separately and fixed in the housing 1, respectively.

The flow guide plate 6 with a circular shape is disposed between the housing 1 and the light source component 4, and is positioned on the housing 1. The flow guide plate 6 is provided with a polygonal second through hole 61 through which the pipeline 44 is communicated with the first port 11. The second through hole 61 is provided with a plurality of second slots 62 and two third positioning holes 611; the second slot 62 receives the first portion 421 of the second base plate 42 which is snap-fitted in the second slot 62 and extends beyond the first base plate 41, the two third positioning holes 611 are for positioning. In the present example, the flow guide plate 6 is made of an insulation material such as plastic.

In the lighting device 100, the six second base plates 42 of the light source component 4 are snap-fitted into and passing through the second slots 62 to allow ends of the first portions 421 thereof to be received in the first slots 13 of the housing 1, so as to achieve the positioning among the light source component 4, the flow guide plate 6, and the housing 1. The lighting device 100 further includes two screws (not illustrated), which pass through the second positioning hole 411 of the first base plate 41, pass through the third positioning hole 611 of the flow guide plate 6, and are received in the first positioning hole 121 of the housing 1; furthermore, the first base plate 41 is abutted against the plurality of second ribs 15 to form a receiving surface (not illustrated), thereby achieving a fixed connection among the light source component 4, the flow guide plate 6, and the housing 1. In other examples, other connection methods such as bonding, snap-clip connecting and welding may be adopted.

Figure 7:
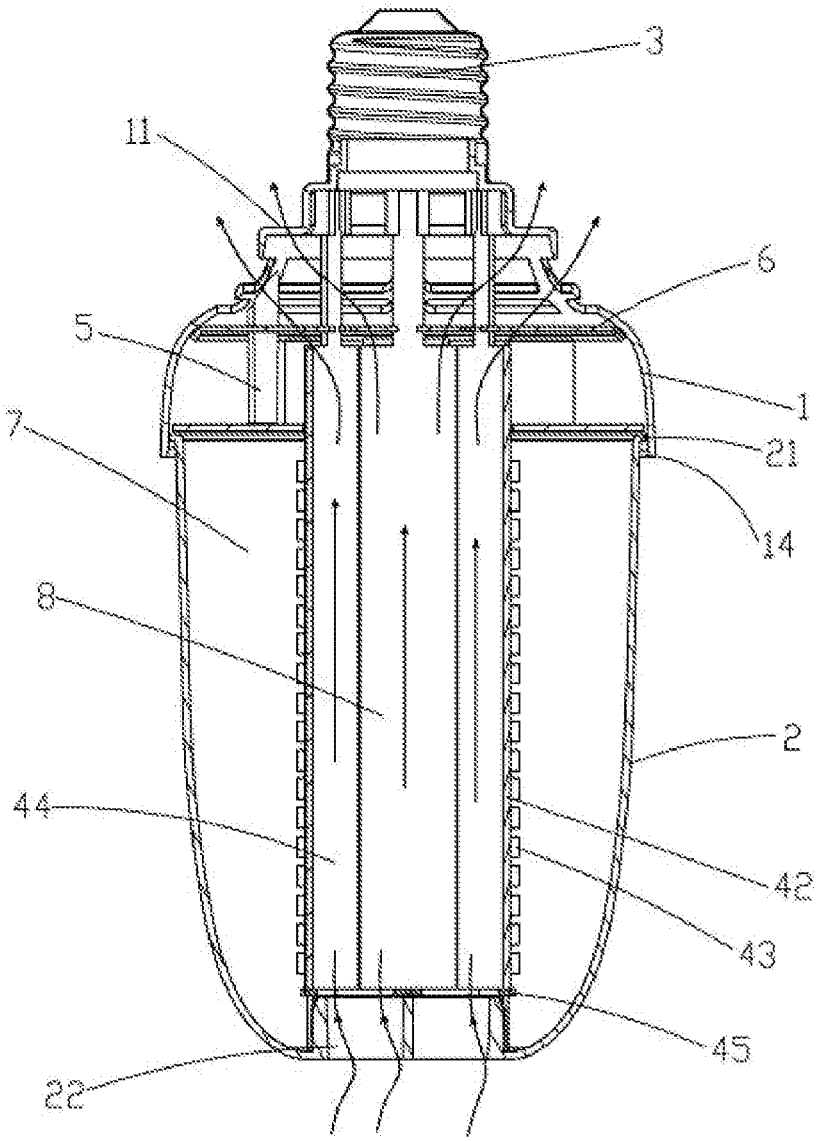
FIG. 7 shows a cross-sectional view within lines A and A of FIG. 1.

As illustrated in FIG. 7, a heat source in the lighting device 100 of the example of the present disclosure is the light source 43 and the driving power supply component 5. By providing the plurality of passages 8, it allows cross-ventilation between external air and internal air of the lighting device 100, so as to dissipate heat. The first opening 22, the pipeline 44, and the first port 11 form the passage 8 to realize cross-ventilation. When the lighting fixture 100 is in operation, the first opening 22 is an air inlet; cold air enters the first opening 22, flows through the pipeline 44, and finally exits from the first port 11 under the action of the flow guide plate 6; the first port 11 is an air outlet. The light source 43 generates heat when emitting light, the air inside the passages 8 is heated and a density of the heated air is decreased to generate upward buoyancy. The air passes through the convection passages 8 and rapidly exits from the air outlet under the action of the flow guide plate 6.

Moreover, the driving power supply component 5 is located near the air outlet, and the heat generated by the driving power supply component 5 causes the air in the corresponding position to be heated rapidly, which enhances the cross-ventilation effect of the air, thereby enhancing the function of chimney effect. A size of the air inlet, a cross-sectional area of the heat dissipation passage, a size of the air outlet and a position of the heat source are reasonably designed to greatly accelerate the air flow effect, so that the cross-ventilation effect is doubled and the temperature is reduced by more than 15° C. The temperature of the light source 43 and the driving power supply component 5 is decreased, which improves the reliability and service life of the lighting device. The passage 8 is formed by the maximum surface area of the second base plates 42 and is in sufficient contact with the air so as to dissipate heat.

The lighting device omits an additional heat dissipation structure, and thus saves the cost of the heat dissipation structure. By reasonable structural design, it achieves rapid and effective heat dissipation, and solves the problem of difficulty in heat dissipation of the lighting device.

In summary, the lighting device 100 has the characteristics of good heat dissipation effect, thereby increasing the service life of the light source component 4 in the lighting device 100. On the other hand, because the materials of respective components are light in weight, the weight of the entire lighting device 100 is reduced.

The present disclosure provides a lighting device with light weight and good heat dissipation effect.

Examples of the present disclosure provide a lighting device, including: a housing; an optical element connected with the housing; a receiving chamber formed by engaging the housing with the optical element; and a light source component and a driving power supply component both located in the receiving chamber. The lighting device further includes a passage located in the receiving chamber, the passage passes through the housing and the optical element, an interior of the lighting device is communicated with an exterior of the lighting device by the passage.

Further, the passage includes a pipeline located in the receiving chamber, the light source component includes a light source, and the light source is disposed on an outer wall of the pipeline.

Further, the light source component includes a base plate connected with the light source, and the base plate constitutes a portion of the outer wall of the pipeline.

Further, the driving power supply component and the light source component are integrally disposed on the base plate or separately disposed in the housing.

Further, the optical element is formed with a first opening, a pipeline is delimited by the light source component, the housing is formed with a first port, and the pipeline is communicated with the first port and the first opening respectively to form the passage.

Further, a maximum outer diameter formed by the first port has a dimension greater than that of a maximum outer diameter formed by the first opening.

Further, the first port is in an arc shape, and a plurality of first ports is arranged in a ring shape.

Further, the lighting device further includes a flow guide plate, the flow guide plate is disposed between the housing and the light source component, and the flow guide plate is provided with a second through hole, through which the pipeline is communicated with the first port.

Further, the light source component includes a first base plate, a plurality of second base plates snap-fitted at the first base plate, and a light source disposed on each of the plurality of second base plates.

Further, an optical chamber of the light source is delimited by the first base plate and the optical element.

Further, the second base plate is vertically snap-fitted at the first base plate, the pipeline is delimited by the plurality of the second base plates, and the light source is disposed at an outer side of the pipeline.

Further, light sources are vertically arranged on the second base plate.

Further, the lighting device further includes a fixing ring, the fixing ring is snap-fitted at an end of the second base plate extending towards the optical element, and the fixing ring is formed with a plurality of grids through which the pipeline is communicated with the passage.

Further, the light source component and the driving power supply component are separately disposed, and the driving power supply component is fixed inside the housing and is electrically connected with the light source component.

Further, the optical element is a lens or a diffusion cover.

Further, the lighting device further includes a lamp head, the lamp head is disposed at an end of the housing.

The lighting device provided by the present disclosure is provided with a passage which passes through the housing and the optical element, and allows the interior of the lighting device to be communicated with the exterior of the lighting device. By means of the passage, cross-ventilation between external air and internal air of the lighting device can be realized. In this way, the heat generated by the light source component and the driving power supply component in the lighting device can be effectively and quickly dissipated through the above-mentioned passage, and no additional heat dissipation component is required, thereby reducing the cost and the weight of the lighting device.

The present disclosure also provides of manufacturing a lighting device. The method may include providing a housing, and an optical element connected with the housing, forming a receiving chamber by engaging the housing with the optical element, providing a light source component and a driving power supply component both located in the receiving chamber, and providing a passage located in the receiving chamber, where the passage passes through the housing and the optical element, and an interior of the lighting device is communicated with an exterior of the lighting device by the passage.

The examples described above further describe the objectives, technical solutions and beneficial effects of the present disclosure in detail. It should be understood that the above are merely examples of the present disclosure and are not intended to limit the present disclosure. Any modification, equivalent replacement, improvement, etc. made within the spirit and principle of the present disclosure should be included in the protection scope of the present disclosure.

The invention claimed is:

1. A lighting device, comprising:

a housing, an optical element connected with the housing, a receiving chamber formed by engaging the housing with the optical element, a light source component and a driving power supply component both located in the receiving chamber, a passage located in the receiving chamber, wherein the passage passes through the housing and the optical element, and an interior of the lighting device is communicated with an exterior of the lighting device by the passage, and a fixing ring placed on an inner surface of an end of the optical element, wherein the fixing ring is fixed with a plurality of second base plates included in the passage, the fixing ring has substantially the same shape as a cross-section formed by the plurality of second base plates and as a first opening formed at the end of the optical element, and the end of the optical element is communicated with the passage through the fixing ring and the first opening.

2. The lighting device according to claim 1, wherein:

the passage comprises a pipeline located in the receiving chamber, and the light source component comprises a light source, and the light source is disposed on an outer wall of the pipeline.

3. The lighting device according to claim 2, wherein the light source component comprises a base plate connected with the light source, the base plate constitutes a portion of the outer wall of the pipeline.

4. The lighting device according to claim 2, wherein the driving power supply component and the light source component are integrally disposed on the base plate or separately disposed in the housing.

5. The lighting device according to claim 1, wherein:

the optical element is formed with the first opening, a pipeline is delimited by the light source component, and the housing is formed with a first port, and the pipeline is communicated with the first port and the first opening, respectively, to form the passage.

6. The lighting device according to claim 5, wherein a maximum outer diameter formed by the first port has a dimension greater than that of a maximum outer diameter formed by the first opening.

7. The lighting device according to claim 5, wherein the first port is in an arc shape, and a plurality of first ports is arranged in a ring shape.

8. The lighting device according to claim 7, further comprising:

a flow guide plate, wherein the flow guide plate is disposed between the housing and the light source component and the flow guide plate is provided with a second through hole, and the pipeline is communicated with the first port by the second through hole.

9. The lighting device according to claim 1, wherein the light source component comprises a first base plate, the plurality of second base plates snap-fitted at the first base plate, and a light source disposed on each of the plurality of second base plates.

10. The lighting device according to claim 9, wherein an optical chamber of the light source is delimited by the first base plate and the optical element.

11. The lighting device according to claim 10, wherein:

the second base plate is vertically snap-fitted at the first base plate, the pipeline is delimited by the plurality of the second base plates, and the light source is disposed at an outer side of the pipeline.

12. The lighting device according to claim 11, wherein light sources are vertically arranged on the second base plate.

13. The lighting device according to claim 12, wherein the fixing ring is snap-fitted at an end of the second base plate which is extending towards the optical element, and the fixing ring is formed with a plurality of grids through which the pipeline is communicated with the passage.

14. The lighting device according to claim 1, wherein:

the light source component and the driving power supply component are separately disposed, and the driving power supply component is fixed inside the housing and is electrically connected with the light source component.

15. The lighting device according to claim 1, wherein the optical element is a lens or a diffusion cover.

16. The lighting device according to claim 1, further comprising a lamp head, wherein the lamp head is disposed at an end of the housing.

17. A method of manufacturing a lighting device, comprising:

providing a housing, and an optical element connected with the housing, forming a receiving chamber by engaging the housing with the optical element, providing a light source component and a driving power supply component both located in the receiving chamber, providing a passage located in the receiving chamber, wherein the passage passes through the housing and the optical element, and an interior of the lighting device is communicated with an exterior of the lighting device by the passage, and providing a fixing ring placed on an inner surface of an end of the optical element, wherein the fixing ring is fixed with a plurality of second base plates included in the passage, the fixing ring has substantially the same shape as a cross-section formed by the plurality of second base plates and as a first opening formed at the end of the optical element, and the end of the optical element is communicated with the passage through the fixing ring and the first opening.

18. The method according to 17, further comprising:

forming the optical element with the first opening, delimiting a pipeline by the light source component, and forming the housing with a first port, and communicating the pipeline with the first port and the first opening, respectively, to form the passage.

19. The method according to 18, wherein a maximum outer diameter formed by the first port has a dimension greater than that of a maximum outer diameter formed by the first opening.

20. The method according to 18, wherein the first port is in an arc shape, and a plurality of first ports is arranged in a ring shape.

* * * * *